US011244642B2

(12) United States Patent
Feng et al.

(10) Patent No.: US 11,244,642 B2
(45) Date of Patent: Feb. 8, 2022

(54) DISPLAY PANEL, DISPLAY DEVICE, AND METHOD FOR DRIVING THE DISPLAY PANEL

(71) Applicants: Beijing BOE Display Technology Co., Ltd., Beijing (CN); BOE Technology Group Co., Ltd., Beijing (CN)

(72) Inventors: Bo Feng, Beijing (CN); Shijun Wang, Beijing (CN); Hongming Zhan, Beijing (CN); Xi Chen, Beijing (CN)

(73) Assignees: Beijing BOE Display Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 63 days.

(21) Appl. No.: 16/658,385

(22) Filed: Oct. 21, 2019

(65) Prior Publication Data

US 2020/0286435 A1 Sep. 10, 2020

(30) Foreign Application Priority Data

Mar. 8, 2019 (CN) ..... 201910176184.X

(51) Int. Cl.
*G09G 3/36* (2006.01)

(52) U.S. Cl.
CPC ... *G09G 3/3614* (2013.01); *G09G 2300/0426* (2013.01); *G09G 2310/0202* (2013.01); *G09G 2310/0248* (2013.01)

(58) Field of Classification Search
None
See application file for complete search history.

(56) References Cited

U.S. PATENT DOCUMENTS

| | | | | |
|---|---|---|---|---|
| 5,708,454 | A * | 1/1998 | Katoh | G09G 3/3648 345/100 |
| 8,004,480 | B2 * | 8/2011 | Kim | G09G 3/3291 345/82 |
| 2003/0038766 | A1 * | 2/2003 | Lee | G09G 3/3648 345/87 |
| 2003/0174119 | A1 * | 9/2003 | Nishi | G09G 3/3614 345/100 |
| 2004/0051688 | A1 * | 3/2004 | Orii | G09G 3/3648 345/87 |
| 2005/0024547 | A1 * | 2/2005 | Park | G09G 3/3688 349/39 |
| 2005/0162917 | A1 * | 7/2005 | Yoo | G09G 3/3648 365/185.22 |
| 2006/0139282 | A1 * | 6/2006 | Gotou | G09G 3/3685 345/96 |

(Continued)

*Primary Examiner* — Patrick N Edouard
*Assistant Examiner* — Peijie Shen
(74) *Attorney, Agent, or Firm* — Arent Fox LLP; Michael Fainberg

(57) ABSTRACT

Disclosed are a display panel, a display device, and a method for driving the same. The display panel includes a plurality of data lines extending in a first direction, and at least one signal compensation line extending in a second direction, insulated from and intersecting with the plurality of data lines, a compensation capacitor is arranged at a position where the plurality of data lines intersect with the signal compensation line, and one terminal of the compensation capacitor is connected with one of the plurality of data lines, and the other terminal of the compensation capacitor is connected with the signal compensation line.

9 Claims, 4 Drawing Sheets

(56) References Cited

U.S. PATENT DOCUMENTS

| | | | | |
|---|---|---|---|---|
| 2007/0013573 | A1* | 1/2007 | Hashimoto | G09G 3/3614 341/172 |
| 2008/0284771 | A1* | 11/2008 | Matsuki | G09G 3/3692 345/211 |
| 2009/0201437 | A1* | 8/2009 | Park | G02F 1/136213 349/37 |
| 2010/0277494 | A1* | 11/2010 | Cho | G09G 3/3614 345/589 |
| 2012/0293496 | A1* | 11/2012 | Park | G09G 3/3233 345/419 |
| 2013/0120349 | A1* | 5/2013 | Oh | G09G 3/3685 345/212 |
| 2015/0123961 | A1* | 5/2015 | Park | G09G 3/3688 345/212 |
| 2015/0160489 | A1* | 6/2015 | Kim | G02F 1/1345 349/139 |
| 2015/0277192 | A1* | 10/2015 | Park | G02F 1/136286 349/43 |
| 2017/0116906 | A1* | 4/2017 | Tai | G09G 3/2014 |
| 2017/0270889 | A1* | 9/2017 | Kang | G09G 3/3677 |
| 2020/0027414 | A1* | 1/2020 | Aoki | G09G 3/3614 |

* cited by examiner

| |
|---|
| apply a compensation signal with the same polarity as a data signal on the compensation signal line ahead of a first preset length of time before the data signal is applied to a data line according to an image to be displayed, so that voltage is applied ahead to the data line |

S100

DISPLAY PANEL, DISPLAY DEVICE, AND METHOD FOR DRIVING THE DISPLAY PANEL

CROSS-REFERENCE TO RELATED APPLICATION

This application claims priority of Chinese Patent Application No. 201910176184.X, filed on Mar. 8, 2019, which is hereby incorporated by reference in its entirety.

FIELD

The present disclosure relates to the field of semiconductor technologies, and particularly to a display panel, a display device, and a method for driving the display panel.

BACKGROUND

Flat Panel Displays (FPDs) have become predominant in the market, and there are a greater variety of flat panel displays, e.g., a Liquid Crystal Display (LCD), an Organic Light-Emitting Diode (OLED) display, a Plasma Display Panel (PDP), a Field Emitting Display (FED), etc.

SUMMARY

Some embodiments of the disclosure provide a display panel including a plurality of data lines extending in a first direction, and at least one signal compensation line extending in a second direction, insulated from and intersecting with the plurality of data lines, wherein:

a compensation capacitor is arranged at a position where the plurality of data lines intersect with the signal compensation line, and one terminal of the compensation capacitor is connected with one of the plurality of data lines, and the other terminal of the compensation capacitor is connected with the signal compensation line.

In a possible implementation, the display panel includes two signal compensation lines, which are a first signal compensation line and a second signal compensation line respectively, first compensation capacitors are arranged at positions where odd columns of data lines in the plurality of data lines intersect with the first signal compensation line, and second compensation capacitors are arranged at positions where even columns of data lines in the plurality of data lines intersect with the second signal compensation line.

In a possible implementation, the display panel includes one signal compensation line, and compensation capacitors are arranged at positions where the plurality of data lines intersect with the signal compensation line.

In a possible implementation, the display panel includes a plurality of pixel elements, and a gate line connected with the plurality of pixel element, and the signal compensation line is at a layer same as a layer where the gate lines are.

In a possible implementation, the first direction is perpendicular to the second direction.

In a possible implementation, the display panel includes a display area, and a non-display area surrounding the display area, wherein the signal compensation line is in the non-display area.

Some embodiments of the disclosure further provide a display device including the display panel according to embodiments above of the disclosure.

Some embodiments of the disclosure further provide a method for driving the display panel according to embodiments above of the disclosure, the driving method including:

applying a compensation signal with a polarity same as a polarity of a data signal on the compensation signal line in advance, before the data signal is applied to a data line according to an image to be displayed, so that voltage is applied to the data line in advance.

In a possible implementation, the display panel includes two signal compensation lines, which are a first signal compensation line and a second signal compensation line respectively, first compensation capacitors are arranged at positions where odd columns of data lines in the plurality of data lines intersect with the first signal compensation line, and second compensation capacitors are arranged at positions where even columns of data lines in the plurality of data lines intersect with the second signal compensation line; and the applying a compensation signal with a polarity same as a polarity of a data signal on the compensation signal line in advance includes:

applying a data signal with a first polarity to odd columns of data lines, applying a data signal with a second polarity to even columns of data lines;

applying a first compensation signal with the first polarity, to the first compensation signal line, and applying a second compensation signal with the second polarity to the second signal compensation line in advance.

In a possible implementation, the applying a compensation signal with a polarity same as a polarity of a data signal on the compensation signal line in advance includes:

applying the compensation signal with a polarity same as a polarity of the data signal to the compensation signal line ahead of the data signal a first preset length of time, wherein the compensation signal is of a first preset periodicity, and the first preset periodicity is greater than or equal to a periodicity at which the data signal is applied to the data line.

In a possible implementation, the applying a compensation signal with a polarity same as a polarity of a data signal on the compensation signal line in advance includes:

applying the compensation signal with a polarity same as a polarity of a data signal to the compensation signal line in advance after a data pulse trigger signal is enabled, wherein a length of delay time between applying the compensation signal and enabling the data pulse trigger signal is a period of time during which a gate signal applied to a gate line preceding to a gate line connected with the pixel elements drops from a high level to a low level.

DETAILED DESCRIPTION OF THE EMBODIMENTS

In order to make the objects, technical solutions, and advantages of the embodiments of the disclosure more apparent, the technical solutions according to the embodiments of the disclosure will be described below clearly and fully with reference to the drawings in the embodiments of the disclosure. Apparently the embodiments to be described are only a part but not all of the embodiments of the disclosure. Based upon the embodiments here of the disclosure, all the other embodiments which can occur to those ordinarily skilled in the art without any inventive effort shall come into the scope of the disclosure as claimed.

Unless defined otherwise, technical terms or scientific terms throughout the disclosure shall convey their usual meaning as appreciated by those ordinarily skilled in the art to which the disclosure pertains. The terms "first", "second", or the like throughout the disclosure do not suggest any order, number or significance, but is only intended to distinguish different components from each other. Alike the terms "include", "comprise", or the like refer to that an element or an item preceding to the term encompasses an element(s) or an item(s) succeeding to the term, and its (or their) equivalence(s), but shall not preclude another element(s) or item(s). The term "connect", "connected", or the like does not suggest physical or mechanical connection, but may include electrical connection no matter whether it is direct or indirect. The terms "above", "below", "left", "right", etc., are only intended to represent a relative positional relationship, and when the absolute position of an object as described is changed, the relative positional relationship may also be changed accordingly.

The display devices in the related art are evolving toward display devices with a high definition and a high refresh rate. However, display elements may not be charged sufficiently, thus degrading the quality of a displayed image.

In order to for a clear and concise description below of embodiments of the disclosure, a detailed description of known functions and components will be omitted in the description.

Figure 1:
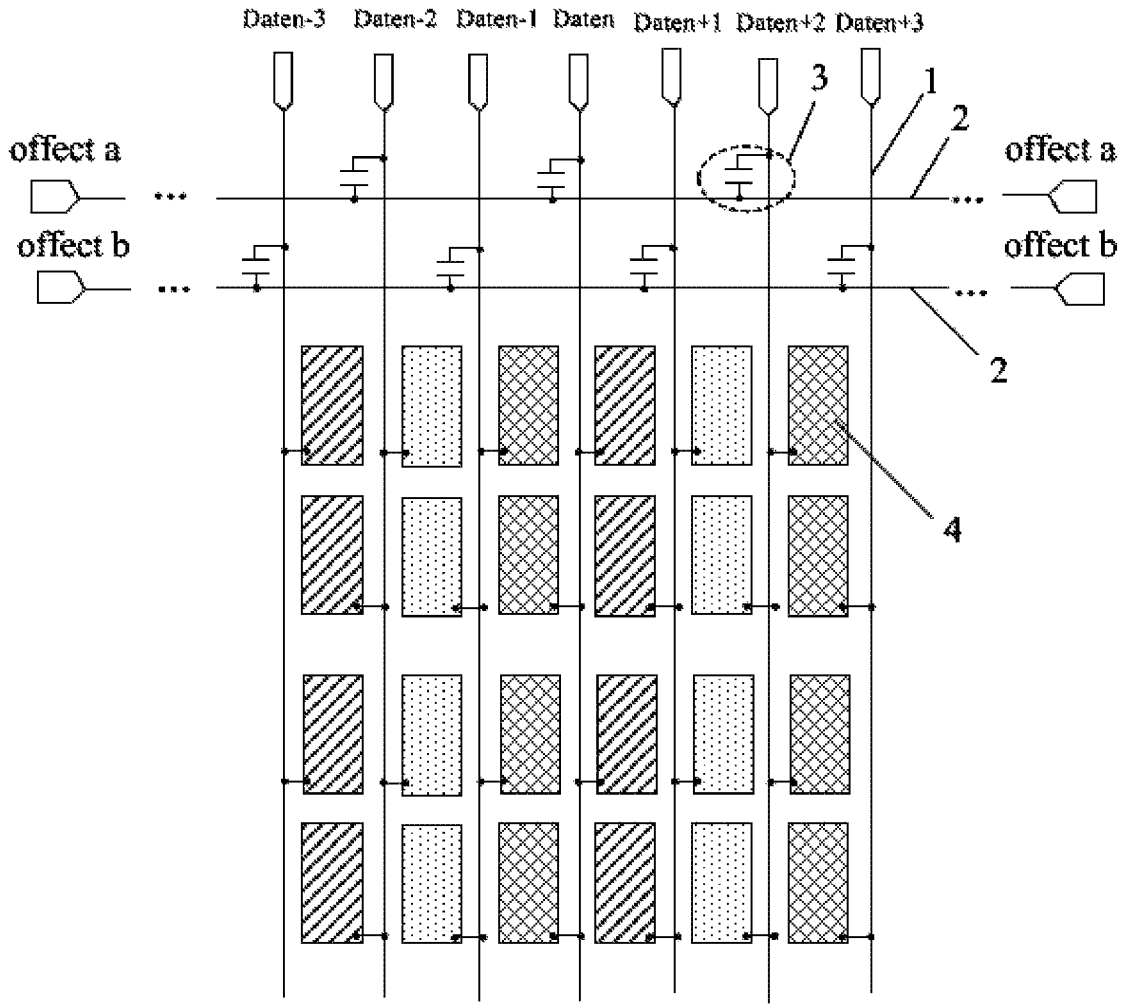
FIG. 1 is a schematic structural diagram of a display panel according to some embodiments of the disclosure.

As illustrated in FIG. 1, some embodiments of the disclosure provide a display panel including a display area in which pixel elements 3 are arranged, and a non-display area surrounding the display area, where the display panel includes a plurality of data lines 1 extending in a first direction (e.g., Daten-3, Daten-2, Daten-1, Daten, Daten+1, Daten+2, and Daten+3), and at least one signal compensation line 2 located in the non-display area, extending in the direction perpendicular to the first direction, and insulated from the data lines 1 (e.g., offect a and offect b in FIG. 1), where a compensation capacitor 3 is arranged at the position where each data line 1 intersects with the signal compensation line 2, and has one terminal connected with the data line 1, and the other terminal connected with the signal compensation line 2; and the compensation capacitor 3 can be configured to apply a compensation signal with the same polarity as a data signal to the compensation signal line ahead of a first preset length of time before the data signal is applied to the data line 1 according to an image to be displayed, so that voltage is applied ahead to the data line 1. In a particular implementation, adjacent rows of pixel elements 4 can be connected with the data lines 1 on different sides, that is, as illustrated in FIG. 1, the first row of pixel elements 4 are connected with the data line 1 to the left thereof, and the second row of pixel elements 4 are connected with the data line to the right thereof, so that the image can be displayed at a higher quality.

The display panel according to the embodiment of the disclosure includes a plurality of data lines extending in a first direction, and at least one signal compensation line located in a non-display area, extending in the direction perpendicular to the first direction, and insulated from the data lines, where a compensation capacitor is arranged at the position where each data line intersects with the signal compensation line, and has one terminal connected with the data line, and the other terminal connected with the signal compensation line; and the compensation capacitor is configured to apply a compensation signal with the same polarity as a data signal to the compensation signal line ahead of a first preset length of time before the data signal is applied to the data line according to an image to be displayed, that is, voltage is applied ahead to the data line to thereby compensate ahead for pixel elements to be compensated for, and the data signal is further applied to the data line, so that the pixel elements can be charged to expected voltage to thereby shorten a period of time for the voltage of the data signal to rise to the expected voltage, so as to improve a charging capacity for the purpose of compensated charging, thus addressing the problem in the prior art that the display elements in the display device may not be charged sufficiently, thus degrading the quality of a displayed image.

In a particular implementation, the number of compensation signal lines in embodiments of the disclosure can be set particularly as needed for the display panel.

Figures 4, 5:
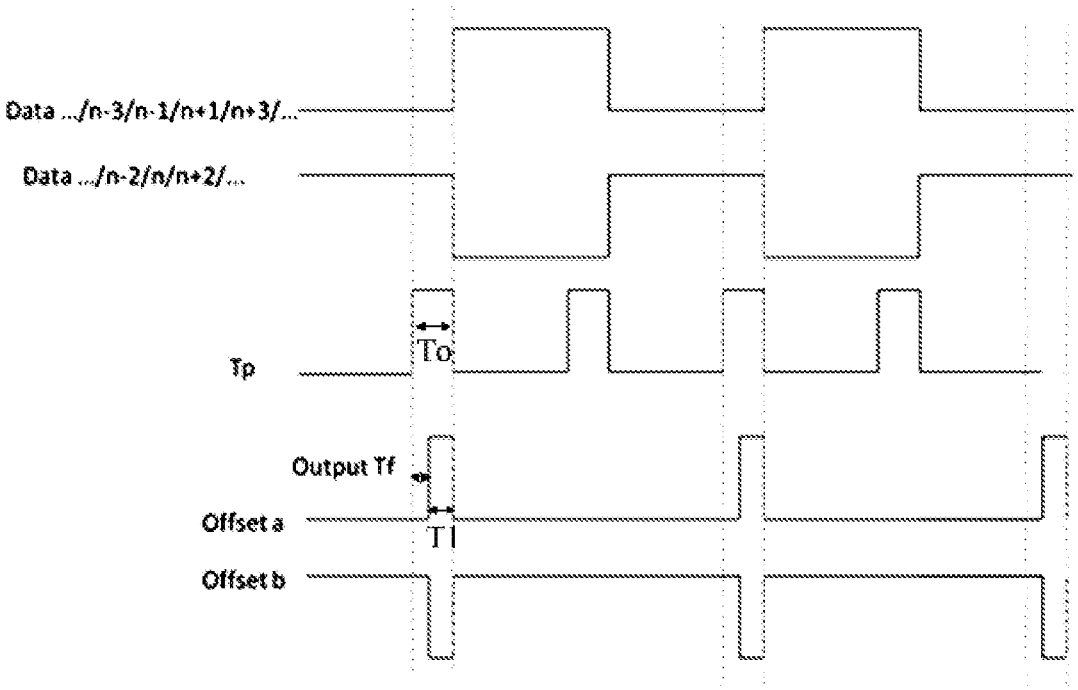
FIG. 4 is a schematic diagram of different signals applied to a display panel according to some embodiments of the disclosure.
FIG. 5 is a flow chart of a method for driving the display panel according to some embodiments of the disclosure.

As illustrated in FIG. 1 and FIG. 4, for example, a data signal with a first polarity is applied to odd columns of data lines (columns n−3, n−1, n+1, etc., where n particularly can be an even number) in the display panel, and a data signal with a second polarity is applied to even columns of data lines (columns n−2, n, n+2, etc., where n particularly can be an even number), where the first polarity is opposite to the second polarity, so there are two signal compensation lines 2 in the display panel, which are a first signal compensation line offect a and a second signal compensation line offect b respectively, some compensation capacitors 3 (first compensation capacitors) are arranged at the positions where the odd columns of data lines intersect with the first signal compensation line offect a, and the polarity of a compensation signal applied on the first signal compensation line offect a is the first polarity; and other compensation capacitors 3 (second compensation capacitors) are arranged at the positions where the even columns of data lines intersect with the second signal compensation line offect b, and the polarity of a compensation signal applied on the second signal compensation line offect b is the second polarity. It shall be noted that FIG. 4 illustrates the first polarity which is positive, and the second polarity which is negative, for example, that is, positive voltage is applied to the odd columns of data lines, and negative voltage is applied to the even columns of data lines, but the first polarity can be negative, and the second polarity can be positive in a particular implementation as long as the voltage with the same polarity as the data lines is applied to the corresponding signal compensation lines connected therewith regardless of the polarity of the voltage applied to the odd and even columns of data lines. In some embodiments of the disclosure, data signals with different polarities are applied to the odd and even columns of data lines in the display panel so that the image can be displayed at a higher quality on the display panel. When data signals with different polarities are applied to the odd and even columns of data lines in the display panel, two corresponding signal compensation lines are arranged so that compensation signals with corresponding polarities are applied thereto respectively, and the display elements in the display panel in which data signals with different polarities are applied to different data lines can be further compensated for charging.

Figure 2:
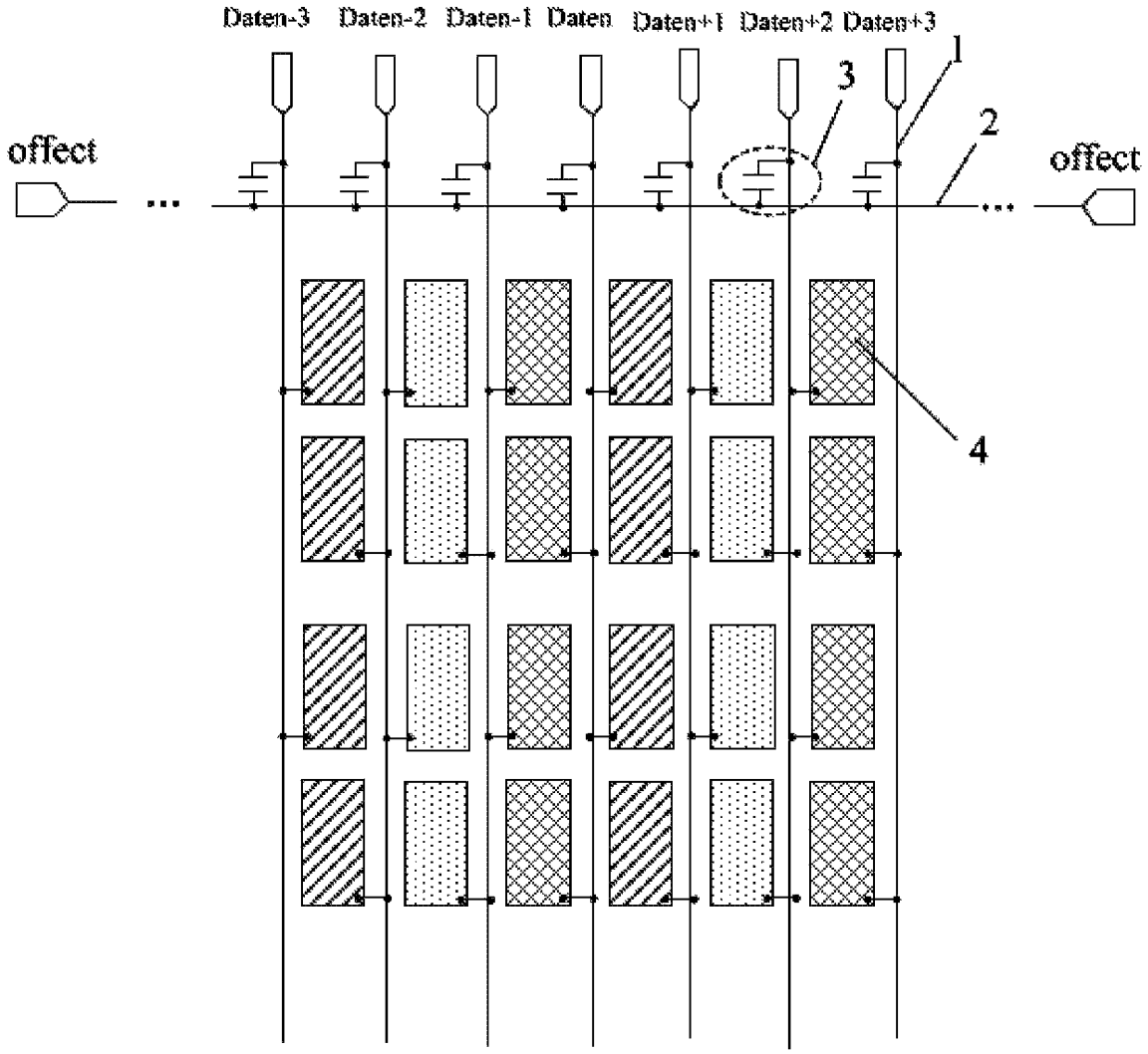
FIG. 2 is a schematic structural diagram of another display panel according to some embodiments of the disclosure.

As illustrated in FIG. 2, in another example, a data signal with the same polarity is applied to each column of data line 1 in the display panel, so a corresponding signal compensation line 2 is arranged in the display panel, and a compensation capacitor 3 is arranged at the position where each data line 1 intersects with the signal compensation line 2.

Figure 3:
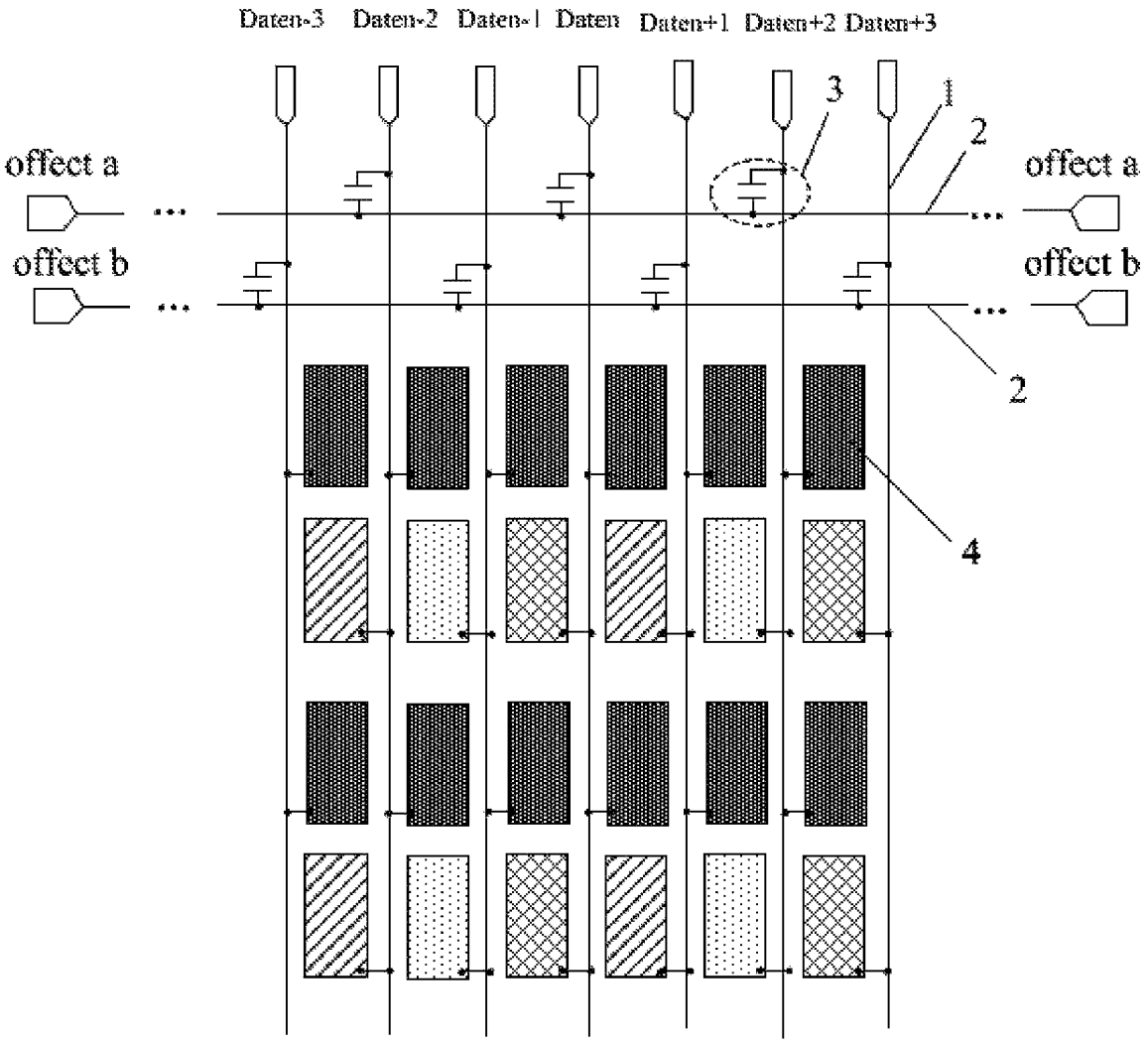
FIG. 3 is a schematic structural diagram of a display panel according to some embodiments of the disclosure, which displays a specific display image.

In a particular implementation, a compensation signal is applied to a compensation capacitor 3 on a signal compensation line 2 at a periodicity longer than or equal to a periodicity at which a data signal is applied on a data line. In some embodiments of the disclosure, a compensation signal is applied to a compensation capacitor 3 on a signal compensation line 2 to make selective compensation according to the image to be displayed, and for example, positive voltage is applied to the odd columns of data lines, and negative voltage is applied to the even columns of data lines, where the first signal compensation line offect a is used for compensation for the odd columns of data lines, and the second signal compensation line offect b is used for compensation for the even columns of data lines, so when the image to be displayed is an image including a row in black, and a row at L255 as illustrated in FIG. 3 and FIG. 4, no compensation signal is applied on the first signal compensation line offect a and the second signal compensation line offect b when the row in black is displayed, and a compensation signal is applied to a compensation capacitor on the first signal compensation line offect a and the second signal compensation line offect b at a periodicity twice a periodicity at which a data signal is applied on a data line, but the compensation signal applied on each signal compensation line is used for compensation for the data signal applied on the data line, so the compensation signal is applied for the data signal to be applied, and even if the data signal is applied on the data line, then it will be decided whether to make compensation for charging as needed in reality, that is, the compensation signal is applied to the compensation capacitor on the signal compensation line at a periodicity longer than or equal to the periodicity at which the data signal is applied on the data line.

In a particular implementation, as illustrated in FIG. 1 and FIG. 4, the display panel includes a plurality of pixel elements 4, and gate lines (not illustrated) connected with the respective pixel elements 4, and for a pixel element 4 to be compensated for, the first preset length of time T1 is the difference between the length of time To for which a data pulse trigger signal (a TP signal) corresponding to the pixel element 4 is enabled, and a second preset length of time Tf, where the second preset length of time Tf (i.e., a length of delay time between applying the compensation signal and enabling the data pulse trigger signal) is a period of time for a gate signal applied to a preceding gate line to a gate line connected with the pixel element to drop from a high level to a low level, that is, a signal on offset a is enabled at a high level, and a signal on offset b is enabled at a low level, after TP has risen for the period of time Tf, where the data pulse trigger signal (the TP signal) is a trigger signal for a source driving integrated circuit to output data voltage $V_S$ to the display panel, and the second preset length of time is a period of time for the gate signal on the preceding gate line to drop from a high level to a low level (that is, the real gate signal cannot drop from a high level to a low level immediately, but it will take a period of time for the gate signal to drop); and in the embodiment of the disclosure, the first preset length of time T1 is the difference between the length of time for which the data pulse trigger signal corresponding to the pixel element is enabled, and the second preset length of time, so a data signal can be avoided from being applied improperly, that is, if a data signal corresponding to a succeeding row of gate line is applied before a preceding row of gate line is disabled, then a data signal which would otherwise have been applied to a succeeding row of pixel elements may be applied improperly to a preceding row of pixel elements.

In a particular implementation, the signal compensation lines are located at the same layer as the gate lines. In some embodiments of the disclosure, the signal compensation lines extent in the same direction as the gate lines, so the signal compensation lines are arranged at the same layer as the gate lines, and the signal compensation lines can be formed at the same time as the gate lines, thus simplifying a process of fabricating the display panel in which a data signal can be compensated for.

In a particular implementation, the display panel includes thin film transistors for driving the pixel elements, and the compensation capacitors are formed at the same time as the thin film transistors. In some embodiments of the disclosure, the compensation capacitors are formed at the same time as the thin film transistors so that the process of fabricating the display panel in which a data signal can be compensated for can be simplified.

Based upon the same inventive idea, some embodiments of the disclosure further provide a display device including the display panel according to the embodiments of the disclosure. The display device according to some embodiments of the disclosure optionally can be a liquid crystal display device.

Based upon the same inventive idea, as illustrated in FIG. 5, some embodiments of the disclosure further provide a method for driving the display panel according to the embodiments of the disclosure, where the driving method includes the following step.

The step S100 is to apply a compensation signal with the same polarity as a data signal on the compensation signal line ahead of a first preset length of time before the data signal is applied to a data line according to an image to be displayed, so that voltage is applied ahead to the data line.

In a particular implementation, there are two signal compensation lines in the display panel, which are a first signal compensation line and a second signal compensation line respectively, compensation capacitors are arranged at the positions where the odd columns of data lines intersect with the first signal compensation line, and compensation capacitors are arranged at the positions where the even columns of data lines intersect with the second signal compensation line.

The applying the compensation signal with the same polarity as the data signal to the compensation signal line ahead of the first preset length of time includes:

applying a compensation signal with a first polarity, to the first compensation signal line, and a compensation signal with a second polarity to the second signal compensation line ahead of the first preset length of time.

In a particular implementation, the applying the compensation signal with the same polarity as the data signal to the compensation signal line ahead of the first preset length of time in the step S100 in embodiments of the disclosure can include: applying the compensation signal with the same polarity as the data signal, and at a first preset periodicity to the compensation signal line ahead of the first preset length of time, where the first preset periodicity is longer than or equal to a periodicity at which the data signal is applied to the data line.

In a particular implementation, the applying the compensation signal with the same polarity as the data signal to the compensation signal line ahead of the first preset length of time in the step S100 in embodiments of the disclosure can include: applying the compensation signal with the same polarity as the data signal to the compensation signal line after a second preset length of time for which a data pulse trigger signal is enabled, where the second preset length of time is a period of time during which a gate signal applied to a preceding gate line to a gate line connected with the pixel element drops from a high level to a low level.

A signal compensation process in the display panel according to embodiments of the disclosure will be described below in details with reference to FIG. 3 and FIG. 4 by way of an example in which positive voltage is applied to the odd columns of data lines, and negative voltage is applied to the even columns of data lines; the first signal compensation line is used for compensation for the odd columns of data lines, and the second signal compensation line is used for compensation for the even columns of data lines; and the image to be displayed is an image including a row in black, and a row at L255, i.e., an H1 Line L255 image, which is the most difficult to charge.

The corresponding row in black of H1 Line corresponds to a data signal at the same Data voltage as Com voltage applied to a common electrode, and the other row of L255 corresponds to Data voltage which is the highest positive voltage or the lowest positive voltage.

When the TP signal is at a high level, data voltage registered in a data integrated circuit IC is pushed to the display panel, and at this time, a data line in the display panel is floating.

The first signal compensation line (Offset a) is a charging compensation signal line of the odd columns of data lines (columns n−3, n−1, n+1, etc., where n particularly can be an even number), and has a periodicity of 2H, and when Data on the odd columns of data lines rises from the Com voltage to the high Data voltage, Offset a is enabled at a high level in such a way that a signal on Offset a is enabled at a high level after the second preset length of time (output tf) for TP to rise.

The second signal compensation line (Offset b) is a charging compensation signal line of the even columns of data lines (columns n−2, n, n+2, etc., where n particularly can be an even number), and has a periodicity of 2H, and when Data on the even columns of data lines drops from the Com voltage to the low Data voltage, Offset b is enabled at a low level in such a way that a signal on Offset b is enabled at a low level after the second preset length of time (output tf) for TP to rise.

The voltage on Offset a and Offset b jumps to pull the floating data line in the display panel in a capacitive manner at this time so that Data is enabled ahead to the voltage with the same polarity to thereby shorten a period of time for Data Tr to rise or drop to the expected voltage, so as to improve a charging capacity for the purpose of compensated charging.

In a particular implementation, the voltage value of the high and low levels on offset a and b can be further adjusted to thereby pull the data signal differently, and different offset voltage values can be set according to different H1 Line grayscales for the purpose of compensation.

In a particular implementation, the offset signal remains unchanged at an intermediate level, for an image for which no compensation is required for charging.

Advantageous effects of the embodiments of the disclosure are as follows: the display panel according to the embodiment of the disclosure includes a plurality of data lines extending in a first direction, and at least one signal compensation line located in a non-display area, extending in the direction perpendicular to the first direction, and insulated from the data lines, where a compensation capacitor is arranged at the position where each data line intersects with the signal compensation line, and has one terminal connected with the data line, and the other terminal connected with the signal compensation line; and the compensation capacitor is configured to apply a compensation signal with the same polarity as a data signal to the compensation signal line ahead of a first preset length of time before the data signal is applied to the data line according to an image to be displayed, that is, voltage is applied ahead to the data line to thereby compensate ahead for pixel elements to be compensated for, and the data signal is further applied to the data line, so that the pixel elements can be charged to expected voltage to thereby shorten a period of time for the voltage of the data signal to rise to the expected voltage, so as to improve a charging capacity for the purpose of compensated charging, thus addressing the problem in the prior art that the display elements in the display device may not be charged sufficiently, thus degrading the quality of a displayed image.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A method for driving a display panel, comprising a plurality of data lines extending in a first direction, a signal compensation line extending in a second direction, insulated from and intersecting with the plurality of data lines, and a compensation capacitor arranged at a position where each of the plurality of data lines intersect with the signal compensation line, and one terminal of the compensation capacitor is connected with one of the plurality of data lines, and the other terminal of the compensation capacitor is connected with the signal compensation line; the method comprises:

applying a compensation signal with a polarity same as a polarity of a data signal on the compensation signal line in advance, before the data signal is applied to a data line according to an image to be displayed, so that voltage is applied to the data line in advance;

wherein the applying a compensation signal with a polarity same as a polarity of a data signal on the compensation signal line in advance comprises:

applying the compensation signal with a polarity same as a polarity of a data signal to the compensation signal line in advance after a data pulse trigger signal is enabled, wherein a length of delay time between applying the compensation signal and enabling the data pulse trigger signal is a difference between a length of time for which the data pulse trigger signal is enabled and a second preset length of time corresponding to a period of time for a gate signal on a gate line to drop from a high level to a low level.

2. A display panel, driven by the method of claim 1, the display panel comprising:

a plurality of data lines extending in a first direction, and a signal compensation line extending in a second direction, insulated from and intersecting with the plurality of data lines, wherein:

a compensation capacitor is arranged at a position where each of the plurality of data lines intersect with the signal compensation line, and one terminal of the compensation capacitor is connected with one of the plurality of data lines, and the other terminal of the compensation capacitor is connected with the signal compensation line.

3. The display panel according to claim 2, wherein the display panel comprises a plurality of pixel elements, and a gate line connected with the plurality of pixel element, and the signal compensation line is at a layer same as a layer where the gate lines are.

4. The display panel according to claim 2, wherein the first direction is perpendicular to the second direction.

5. The display panel according to claim 2, wherein the display panel comprises a display area, and a non-display area surrounding the display area, wherein the signal compensation line is in the non-display area.

6. A display device, comprising the display panel according to claim 2.

7. The display device according to claim 6, wherein the display panel comprises a plurality of pixel elements, and a gate line connected with the plurality of pixel element, wherein the signal compensation line is at a layer same as a layer where the gate lines are.

8. The display device according to claim 6, wherein the first direction is perpendicular to the second direction.

9. The display device according to claim 6, wherein the display panel comprises a display area, and a non-display area surrounding the display area, wherein the signal compensation line is in the non-display area.

* * * * *